US007704061B2

(12) United States Patent
Ohnishi et al.

(10) Patent No.: US 7,704,061 B2
(45) Date of Patent: Apr. 27, 2010

(54) OIL PUMP

(75) Inventors: Hideaki Ohnishi, Kanagawa (JP); Yasushi Watanabe, Kanagawa (JP); Shoji Morita, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 921 days.

(21) Appl. No.: 10/984,927

(22) Filed: Nov. 10, 2004

(65) Prior Publication Data

US 2005/0106044 A1 May 19, 2005

(30) Foreign Application Priority Data

Nov. 17, 2003 (JP) ..... 2003-386127

(51) Int. Cl.
*F03C 2/00* (2006.01)
*F04B 11/00* (2006.01)

(52) U.S. Cl. ..... 418/61.3; 418/2; 418/19; 418/166; 418/171; 417/540; 138/26

(58) Field of Classification Search ..... 418/2, 418/61.3, 166, 171, 19; 417/312, 540, 542; 138/26

See application file for complete search history.

(56) References Cited

U.S. PATENT DOCUMENTS

| | | | | |
|---|---|---|---|---|
| 1,591,088 | A * | 7/1926 | Holmes | 181/251 |
| 1,740,805 | A * | 12/1929 | Brice | 181/251 |
| 2,027,359 | A * | 1/1936 | Wood et al. | 181/264 |
| 2,297,046 | A * | 9/1942 | Bourne | 181/250 |
| 3,323,305 | A * | 6/1967 | Klees | 60/469 |
| 3,536,426 | A * | 10/1970 | Albrecht et al. | 418/166 |
| 3,568,791 | A * | 3/1971 | Luxton | 181/224 |
| 4,600,076 | A * | 7/1986 | Yamamoto et al. | 181/233 |
| 5,033,581 | A * | 7/1991 | Feuling | 181/257 |
| 5,046,935 | A * | 9/1991 | Iio et al. | 418/181 |
| 5,201,878 | A * | 4/1993 | Abe et al. | 418/133 |
| 6,633,646 | B1 * | 10/2003 | Hwang | 381/71.5 |
| 6,772,858 | B2 * | 8/2004 | Trochon | 181/224 |
| 6,776,589 | B2 * | 8/2004 | Tomell et al. | 417/415 |
| 6,796,859 | B1 * | 9/2004 | Justen et al. | 440/88 A |
| 6,976,833 | B2 * | 12/2005 | Daniels et al. | 417/312 |
| 7,244,094 | B2 * | 7/2007 | Miura et al. | 415/55.4 |
| 7,361,002 | B2 * | 4/2008 | Ohnishi et al. | 418/61.3 |

FOREIGN PATENT DOCUMENTS

| | | |
|---|---|---|
| CN | 2371376 Y | 3/2000 |
| CN | 2572017 Y | 9/2003 |

(Continued)

OTHER PUBLICATIONS

U.S. Appl. No. 10/985,898, filed Nov. 12, 2004, Ohnishi et al.

*Primary Examiner*—Thomas E Denion
*Assistant Examiner*—Mary A Davis
(74) *Attorney, Agent, or Firm*—Foley & Lardner LLP

(57) ABSTRACT

An oil pump includes pump chambers each having a volume varied by engine drive and for pressurizing oil inhaled through an inlet port and discharge it through an outlet port, and a branch passage connected between upstream and downstream sides of the outlet port at branch and confluent points, wherein the branch passage in the vicinity of the confluent point is shifted in pulse-pressure phase with respect to the outlet port.

19 Claims, 6 Drawing Sheets

FOREIGN PATENT DOCUMENTS

| | | | | |
|---|---|---|---|---|
| JP | 2-43482 | U | | 3/1990 |
| JP | 04-191594 | A | | 7/1992 |
| JP | 09-177535 | A | | 7/1997 |
| JP | 10-318160 | A | | 12/1998 |
| JP | 10318160 | A | * | 12/1998 |
| JP | 11-037063 | A | | 2/1999 |
| JP | 2003-184523 | A | | 7/2003 |
| JP | 2003184523 | A | * | 7/2003 |

* cited by examiner

OIL PUMP

BACKGROUND OF THE INVENTION

The present invention relates to an engine drive oil pump, and more particularly, to an oil pump having function of reducing the pulse pressure within an outlet port.

Japanese document JP-U 2-43482 discloses a trochoid oil pump wherein a plurality of pump chambers defined between inner and outer rotors continuously increase or decrease in volume under an engine driving force to pressurize oil inhaled therein through an inlet port and discharge it to an outlet port. A closed groove is arranged above the outlet port, having an upper portion serving as an air chamber for accumulating air.

Since this oil pump has air chamber formed at the outlet port, the pulse pressure produced by the pump chambers which open successively into the outlet port to discharge oil can be absorbed by the damping action provided by the air chamber.

SUMMARY OF THE INVENTION

With the oil pump disclosed in Japanese document JP-U 2-43482, however, when the pulse-pressure frequency of the outlet port coincides with the resonance frequency of the air chamber, vibrations within the air chamber can become greater, leading to abrupt discharge of air in the air chamber to the outlet port. And if air is relieved from the air chamber by resonance thereof, the pulse-pressure reduction performance is lowered abruptly, thus having a detrimental effect on an actuator driven by discharged oil, etc. and providing disagreeable feel to the vehicle passenger due to sudden change in noise level. That is, when the pump noise level linearly increases roughly in proportion to a rise in engine speed, it may not provide much disagreeable feel to the passenger. However, when the pump noise level varies on the way to rising of the engine speed, the passenger catches it as grating sound.

It is, therefore, an object of the present invention to provide an oil pump which allows a reduction in pulse pressure within the outlet port in a constant and stably way regardless of variations in engine speed.

The present invention provides generally an oil pump which comprises: a plurality of pump chambers each having a volume varied by engine drive, the pump chambers pressurizing oil inhaled through an inlet port and discharge it through an outlet port; and a branch passage connected between upstream and downstream sides of a main passageway at branch and confluent points, wherein the branch passage in a vicinity of the confluent point is shifted in pulse-pressure phase with respect to the main passageway.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
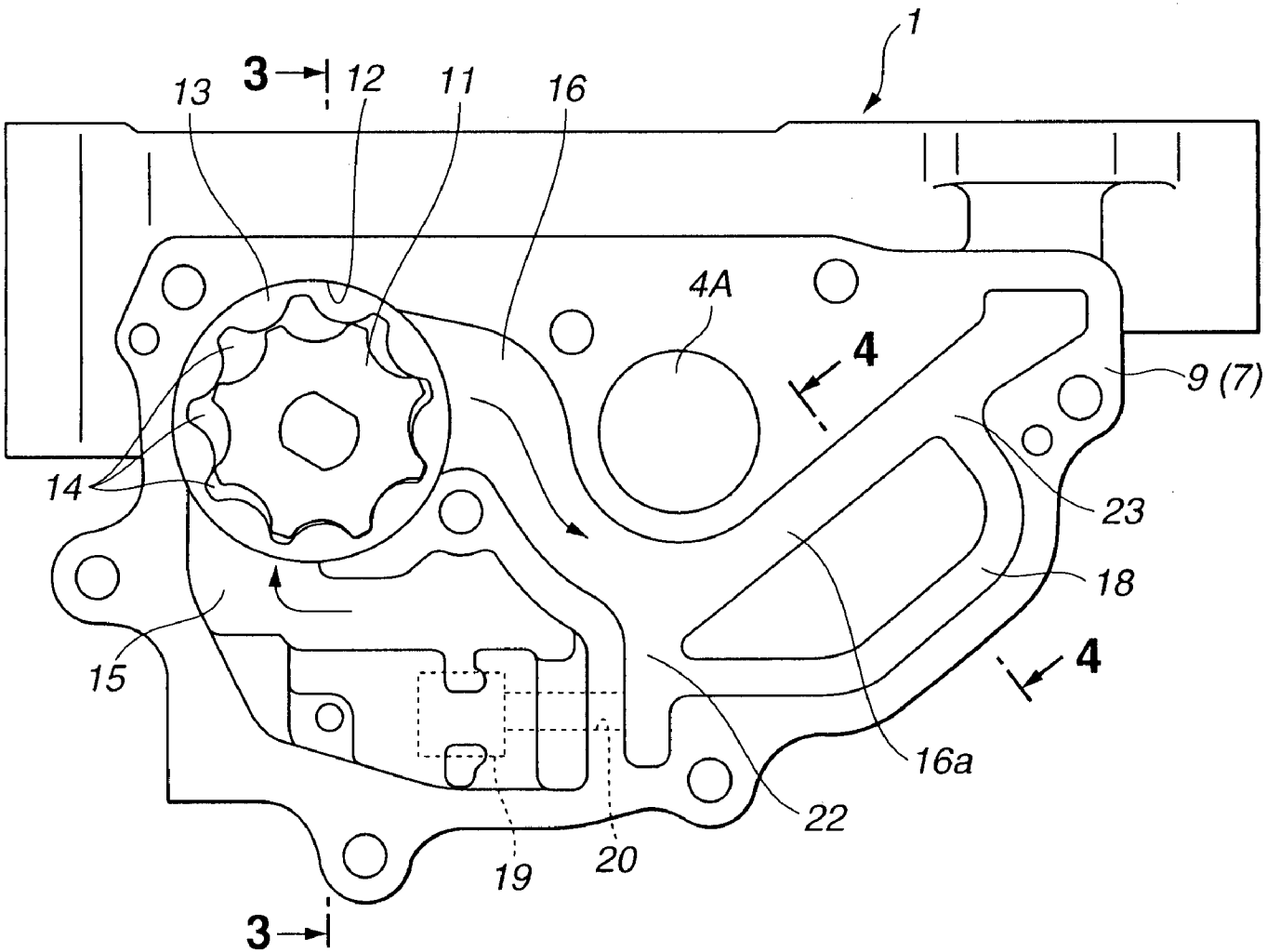
FIG. 1 is an end view taken along the line 1-1 in FIG. 2, showing a first embodiment of an oil pump according to the present invention.

Referring to the drawings, a description will be made about preferred embodiments of an oil pump according to the present invention.

Figure 2:
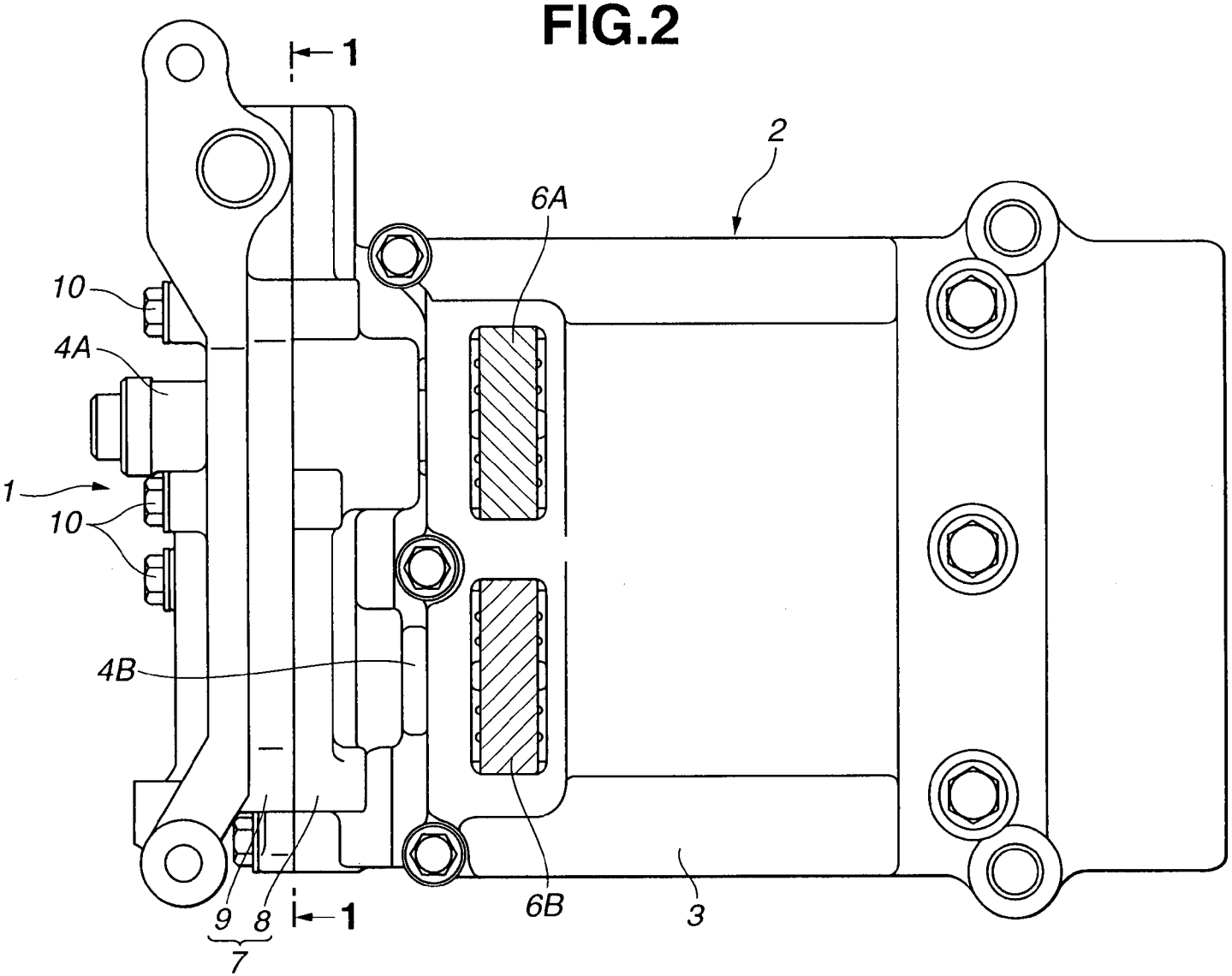
FIG. 2 is a top view showing a balancer of an automotive engine.
Figure 3:
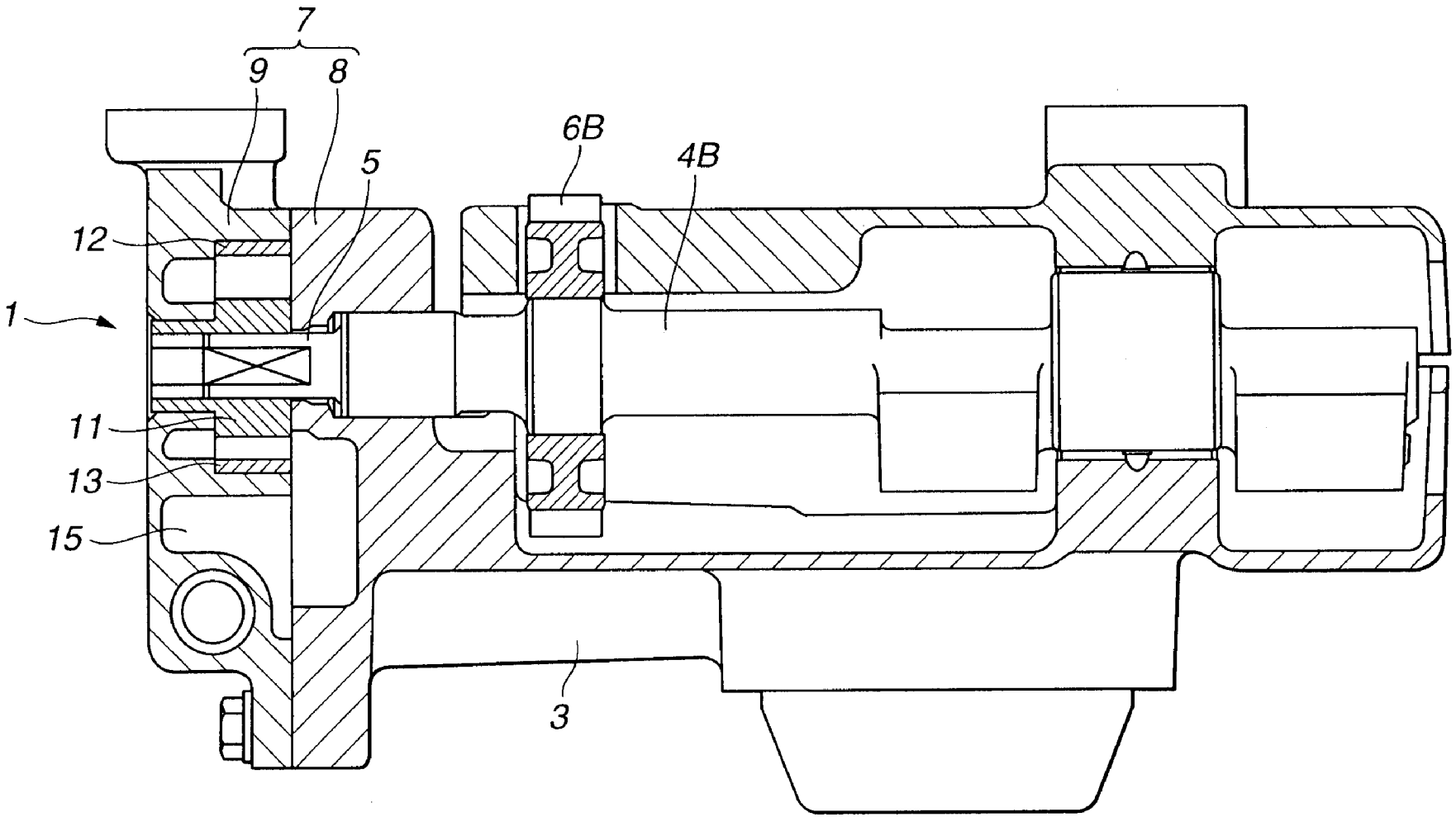
FIG. 3 is a sectional view taken along the line 3-3 in FIG. 1.

Referring to FIGS. 2 and 3, an oil pump 1 is mounted to a balancer 2 of an automotive engine. Balancer 2 comprises a support frame 3 and a balancer shaft 4B having a front end which serves as a drive shaft 5 of oil pump 1.

Balancer 2 comprises a pair of balancer shafts 4A, 4B engaged with synchronous gears 6A, 6B and rotating synchronously in opposite directions, wherein shaft 4A is linked to an engine crankshaft through a chain, not shown, and shaft 4B serves to drive oil pump 1. Balancer shafts 4A, 4B rotate at speed twice as high as the crankshaft, and reduce secondary vibrations of the engine through rotation of weights provided to shafts 4A, 4B. The entirety of balancer 2, including oil pump 1, is disposed in an oil pan, not shown, provided to the bottom of the engine.

A pump housing 7 of oil pump 1 comprises a roughly rectangular base block 8 integrated with a front end of support frame 3 of balancer 2 and a cover block 9 attached to the front face of base block 8, wherein the outer peripheral edges of blocks 8, 9 are coupled together by bolts 10.

A pump main body of oil pump 1 includes a trochoid pump comprising an inner rotor 11 mounted to drive shaft 5 to be rotatable together and an outer rotor 13 rotatably accommodated in a concave 12 of cover block 9. Inner rotor 11 includes outer teeth each composed of a trochoid curve, and outer rotor 13 includes inner teeth each composed of a trochoid curve and having the number of teeth larger than that of the outer teeth of inner rotor 11 by one.

Inner rotor 11 is disposed at the inner periphery of outer rotor 13 and offset from outer rotor 13. In the most offset position, some outer teeth of inner rotor 11 mesh with the inner teeth of outer rotor 12, and the others make slide contact with the inner teeth at a plurality of circumferential positions. A plurality of spaces defined between contact portions of inner rotor 11 and outer rotor 13 serve as pump chambers 14 which continuously increase or decrease in volume with rotation of inner rotor 11.

Pump main body 11, 13 is disposed at the upper portion of one end of oblong pump housing 7 as shown in FIG. 1. An inlet port 15 is formed in pump housing 7 beneath pump main body 11, 13 to inhale oil in the oil pan into the inhalation area of pump main body 11, 13. An outlet port 16 is formed in pump housing 7 to guide oil discharged from the discharge area of pump main body 11, 13 to a discharge passage, not shown. Outlet port 16 starts from pump main body 11, 13, and detours around a protruding end of balancer shaft 4A, extending upward obliquely. An extending end of outlet port 16 is connected to the discharge passage.

A branch passage 18 is formed in pump housing 7 to connect the vicinity of a lower end (upstream side) of an upward extending section 16*a* of outlet port 16 and the vicinity of an upper end (downstream side) thereof. Branch passage 18 is curved downward with respect to upward extending section 16*a* of outlet port 16 which extends linearly. Branch passage 18 is longer than outlet port 16 in a distance between a branch point 22 and a confluent point 23. And outlet port 16 and branch passage 18 are shifted in pulse-pressure phase at confluent point 23.

Figure 4:
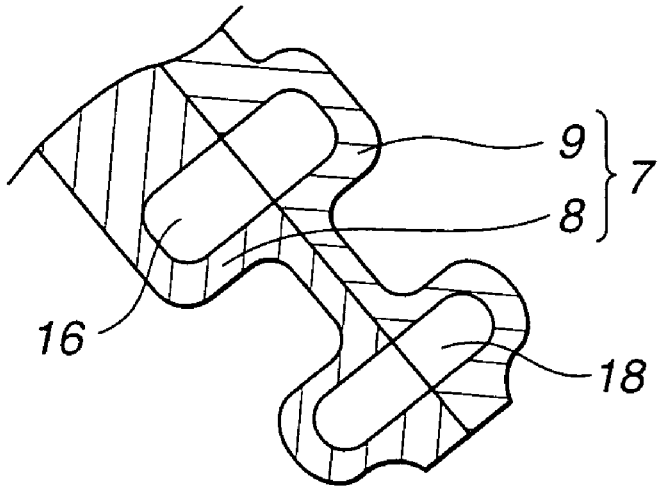
FIG. 4 is a view similar to FIG. 3, taken along the line 4-4 in FIG. 1.

In the first embodiment, the cross-sectional areas of upward extending section 16*a* of outlet port 16 and branch passage 18 are set so that the flow rates of oil flowing through the two are roughly the same. Referring to FIG. 4, outlet port 16 and branch passage 18 are formed in half at a junction between base block 8 and cover block 9.

Referring to FIG. 1, a relief valve 19 is interposed in a return passage 20 for providing fluid communication between outlet port 16 and inlet port 15.

As being constructed as described above, oil pump 1 operates as follows. When balancer shaft 4B rotates with engine start, pump chambers 14 continuously vary in volume due to rotation of inner rotor 11 to continuously discharge oil inhaled through inlet port 15 to outlet port 16. Then, oil discharged to outlet port 16 has pulse pressure in response to pump rotation, which bifurcates into two flows at branch point 22 in the vicinity of the lower end of upward extending section 16*a*. One flow progresses through upward extending section 16*a*, and another flow progresses through branch passage 18. Then, the two oil flows merge with each other at confluent point 23 in the vicinity of the upper end of upward extending section 16*a*. Since it is designed that outlet port 16 and branch passage 18 are shifted in pulse-pressure phase at confluent point 23, the pulse pressure within outlet port 16 and that within branch passage 18 interfere with each other at confluent point 23.

Figure 5:
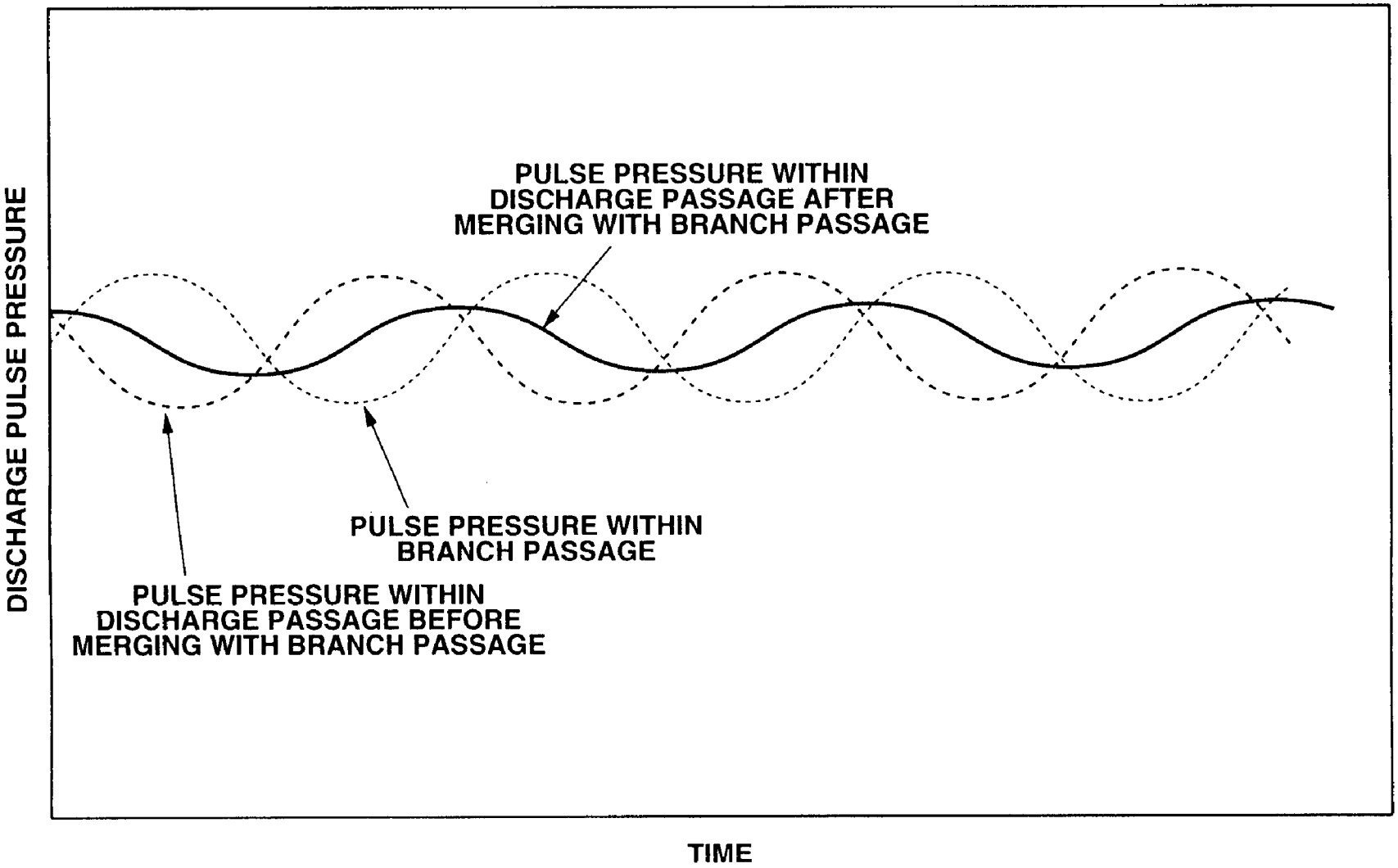
FIG. 5 is a graph showing variations in pulse pressure at given engine speed.

FIG. 5 shows a manner of mutual interference of the pulse pressures at confluent point 23 at given engine speed. As seen from FIG. 5, in the first embodiment, mutual interference of the pulse pressures is carried out at confluent point 2, obtaining sure reduction in variation range of the pulse pressure within outlet port 16. In the first embodiment, particularly, the flow rate of oil flowing through upward extending section 16*a* of outlet port 16 and that of oil flowing through branch passage 18 are set to be roughly the same, thus obtaining a significant effect of reducing the variation range of the pulse pressure.

Moreover, in the first embodiment, oil pump 1 is not constructed to catch air in a specific site such as an air chamber, producing no inconvenience of abrupt change in pulse-pressure reduction characteristic due to relieving of air with a variation in pulse-pressure frequency in response to engine speed.

Figure 6:
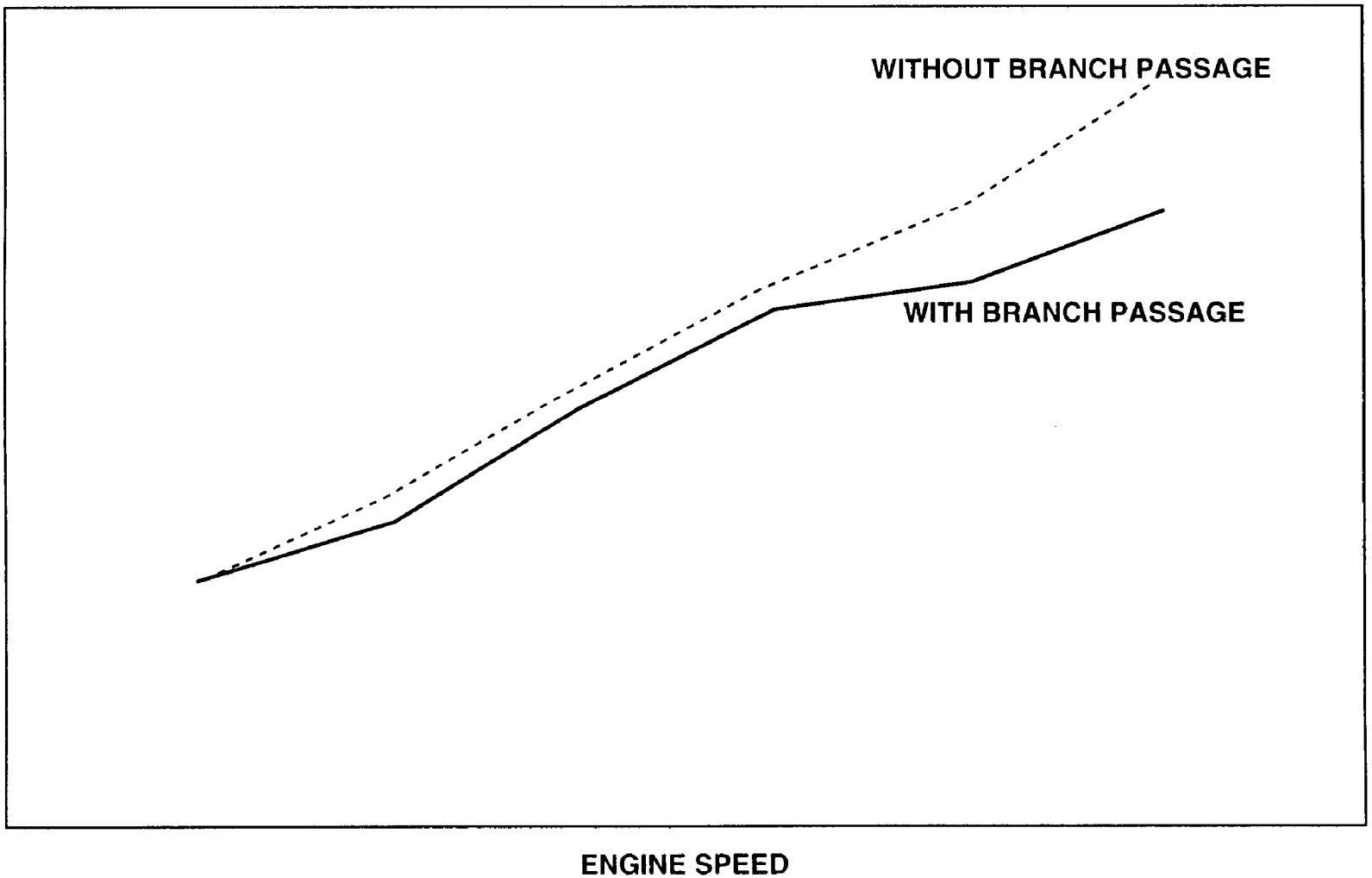
FIG. 6 is a graph similar to FIG. 5, showing the characteristics of discharge pulse pressure vs. engine speed in the first embodiment having a branch passage and a comparative example having no branch passage.

FIG. 6 shows pulse-pressure characteristics in the first embodiment having branch passage 18 and a comparative example having no branch passage 18. As seen from FIG. 6, the first embodiment allows sure reduction in pulse-pressure level in the overall rotation range as compared with the comparative example. Moreover, the first embodiment can provide a linear pulse-pressure characteristic that the pulse-pressure level is substantially proportional to an increase in engine speed without having any abrupt increase in pulse-pressure level during rise in engine speed, which can occur in the oil pump having an air chamber.

Figure 7:
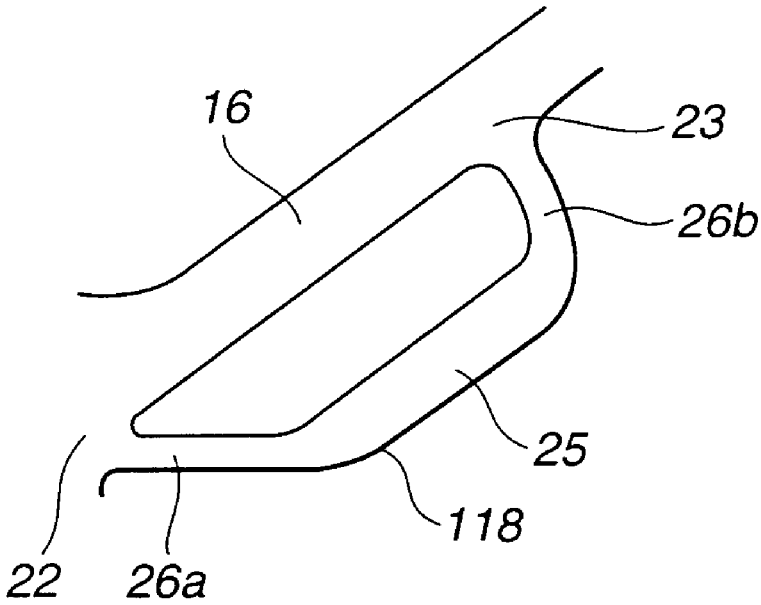
FIG. 7 is an enlarged fragmentary sectional view showing a second embodiment of the present invention.

Referring to FIG. 7, there is shown second embodiment of the present invention which is substantially the same in entire structure as the first embodiment except that throttles 26*a*, 26*b* are formed at both ends of branch passage 18 connected to outlet port 16 at branch point 22 and confluent point 23.

Throttles 26*a*, 26*b* of branch passage 18 at both ends are smaller in cross-sectional area than a general section 25 of branch passage 18. General section 25 having relatively great cross-sectional area as compared with that of throttles 26*a*, 26*b* serves as an oil damper for attenuating the pulse pressure during pump operation.

In the second embodiment, therefore, the oil damping function can be obtained in addition to pulse-pressure interference operation at confluent point 23, resulting in more effective reduction in pulse pressure within outlet port 16. In the second embodiment, throttles 26*a*, 26*b* are arranged at both ends of branch passage 18. Optionally, a single throttle may be arranged at one side of branch passage 18.

As described above, according to the present invention, since oil flowing through the outlet port and oil flowing through the branch passage are shifted in pulse-pressure phase at the confluent point, the pulse pressures within the two interfere with each other, resulting in a reduction in pulse-pressure level at the outlet port. Moreover, the oil pump is not constructed to catch a large amount of air in an air chamber, for example, producing no inconvenience of abrupt change in pulse-pressure reduction performance due to sudden relieving of air by resonance with the pulse pressure within the outlet port.

Further, according to the present invention, since the throttle is arranged at least one end of the branch passage, the branch passage also serves as an oil chamber. Thus, in addition to the above pulse-pressure reduction operation due to pulse-pressure phase shift between the outlet port and the branch passage, the oil-chamber function can be obtained, resulting in more effective reduction in pulse pressure within the outlet port.

Still further, according to the present invention, since the outlet port and the branch passage are roughly the same in pulse-pressure level, mutual-interference operation due to pulse-pressure phase shift becomes greater, resulting in achievement of greater pulse-pressure reduction effect.

Furthermore, according to the present invention, since the pump shaft rotates together with the balancer shafts at speed twice as high as the crankshaft, the pulse-pressure frequency becomes higher as a whole, and thus the pulse-pressure level also becomes higher. However, the oil pump produces no inconvenience of sudden relieving of a large amount of accumulated air, providing a particularly effective solution of achieving a stable pulse-pressure reduction effect under the conditions of higher pulse-pressure level.

Further, according to the present invention, the pump chambers defined between the inner and outer rotors open into the outlet port with rotation of the drive shaft to discharge oil thereto, wherein the pulse pressure within the outlet port can surely be reduced by mutual-interference operation with the pulse pressure within the branch passage.

Having described the present invention in connection with the preferred embodiments, it is noted that the present invention is not limited thereto, and various changes and modifications can be made without departing from the scope of the present invention.

By way of example, in the illustrative embodiments, the pump main body includes a trochoid pump. Optionally, the pump main body may include a vane pump or the like on condition that the pump chambers increase and decrease in volume continuously. Since the oil pump driven by the balancer shafts rotating at high speed as in the illustrative embodiments (although drive of the oil pump is not necessarily carried out through direct coupling to the balancer shafts) is apt to produce high-frequency pulse pressure, the present invention provides particularly effective countermeasure for that.

The entire teachings of Japanese Patent Application P2003-386127 file Nov. 17, 2003 are hereby incorporated by reference.

What is claimed is:

1. An oil pump, comprising:

a plurality of pump chambers each having a volume varied by engine drive, the pump chambers pressurizing oil inhaled through an inlet port and discharging it through a pump chamber outlet port;

a main passageway connected between the pump chamber outlet port and a housing outlet port;

a branch passage connected between upstream and downstream sides of the main passageway at branch and confluent points, the branch passage being in a vicinity of the confluent point and being shifted in pulse-pressure phase with respect to the main passageway; and a pair of throttles, wherein the pair of throttles consists of throttles respectively provided at upstream and downstream end portions of the branch passage, the throttles being smaller in cross-sectional area than a general section of the branch passage which continuously extends and connects between the pair of the throttles between a branch point and a confluent point of the main passageway and the branch passage, wherein the throttles are provided, with respect to the main passageway and the branch passage, in the branch passage.

2. The oil pump as claimed in claim 1, further comprising a balancer shaft which drives the oil pump, the balancer shaft rotating at speed twice as high as a crankshaft to cancel engine secondary vibrations.

3. The oil pump as claimed in claim 1, further comprising:

a drive shaft;

an inner rotor driven by the drive shaft, the inner rotor having an outer periphery formed with external teeth each including a trochoid curve; and an outer rotor disposed at the outer periphery of the inner rotor, the outer rotor being offset with respect to the inner rotor, the outer rotor having an inner periphery formed with internal teeth each including the trochoid curve, the internal teeth being meshed with the external teeth of the inner rotor.

4. The oil pump as claimed in claim 1, further comprising a pump housing, the pump housing comprising a base block and a cover block attached to a front face of the base block, wherein the main passageway and the branch passage are formed in half at a junction between the base block and the cover block, wherein the base block and the cover block are coupled together by a plurality of bolts.

5. The oil pump as claimed in claim 1, wherein the branch passage extends curvedly with respect to the main passageway, which extends linearly.

6. The oil pump as claimed in claim 1, wherein the branch passage has an end portion connected with an upper end portion of the main passageway.

7. An oil pump, comprising:

a plurality of pump chambers each having a volume varied by engine drive, the pump chambers pressurizing oil inhaled through an inlet port and discharging it through a pump chamber outlet port;

a main passageway connected between the pump chamber outlet port and a housing outlet port;

a branch passage connected between upstream and downstream sides of the main passageway at branch and confluent points; and a pair of throttles, wherein the pair of throttles consists of throttles respectively provided at upstream and downstream end portions of the branch passage, the throttles being smaller in cross-sectional area than a general section of the branch passage which continuously extends and connects between the pair of the throttles between a branch point and a confluent point with the main passageway, wherein the main passageway and the branch passage have different distances between the branch point and the confluent point, wherein the throttles are provided, with respect to the main passageway and the branch passage, in the branch passage.

8. The oil pump as claimed in claim 7, further comprising a balancer shaft which drives the oil pump, the balancer shaft rotating at speed twice as high as a crankshaft to cancel engine secondary vibrations.

9. The oil pump as claimed in claim 7, further comprising:

a drive shaft;

an inner rotor driven by the drive shaft, the inner rotor having an outer periphery formed with external teeth each including a trochoid curve; and an outer rotor disposed at the outer periphery of the inner rotor, the outer rotor being offset with respect to the inner rotor, the outer rotor having an inner periphery formed with internal teeth each including the trochoid curve, the internal teeth being meshed with the external teeth of the inner rotor.

10. The oil pump as claimed in claim 7, further comprising a pump housing, the pump housing comprising a base block and a cover block attached to a front face of the base block, wherein the main passageway and the branch passage are formed in half at a junction between the base block and the cover block, wherein the base block and the cover block are coupled together by a plurality of bolts.

11. The oil pump as claimed in claim 7, wherein the branch passage extends curvedly with respect to the main passageway, which extends linearly.

12. The oil pump as claimed in claim 7, wherein the branch passage has an end portion connected with an upper end portion of the main passageway.

13. An oil pump, comprising:

a plurality of pump chambers each having a volume varied by engine drive, the pump chambers pressurizing oil inhaled through an inlet port and discharging it through a pump chamber outlet port;

a main passageway connected between the pump chamber outlet port and a housing outlet port;

a branch passage connected between upstream and downstream sides of the main passageway at branch and confluent points; and a pair of throttles, wherein the pair of throttles consists of throttles respectively provided at upstream and downstream end portions of the branch passage, the throttles being smaller in cross-sectional area than a general section of the branch passage which continuously extends and connects between the pair of throttles between a branch point and a confluent point with the main passageway, wherein the throttles are provided, with respect to the main passageway and the branch passage, in the branch passage.

14. The oil pump as claimed in claim 13, further comprising a balancer shaft which drives the oil pump, the balancer shaft rotating at speed twice as high as a crankshaft to cancel engine secondary vibrations.

15. The oil pump as claimed in claim 13, further comprising:

a drive shaft;

an inner rotor driven by the drive shaft, the inner rotor having an outer periphery formed with external teeth each including a trochoid curve; and an outer rotor disposed at the outer periphery of the inner rotor, the outer rotor being offset with respect to the inner rotor, the outer rotor having an inner periphery formed with internal teeth each including the trochoid curve, the internal teeth being meshed with the external teeth of the inner rotor.

16. The oil pump as claimed in claim 13, further comprising a pump housing, the pump housing comprising a base block and a cover block attached to a front face of the base block, wherein the main passageway and branch passage are formed in half at a junction between the base block and the cover block, wherein the base block and the cover block are coupled together by a plurality of bolts.

17. The oil pump as claimed in claim 13, wherein the branch passage extends curvedly with respect to the main passageway, which extends linearly.

18. The oil pump as claimed in claim 13, wherein the throttles and the general section of the branch passage are adapted to attenuate a pulse pressure within the outlet port.

19. The oil pump as claimed in claim 13, wherein the branch passage has an end portion connected with an upper end portion of the main passageway.

* * * * *